US005644873A

United States Patent [19]

Bourgault

[11] Patent Number: 5,644,873

[45] Date of Patent: Jul. 8, 1997

[54] STAIRS FOR SWIMMING-POOL

[76] Inventor: Jean Bourgault, 1, Bercy Street, Candiac, Quebec, Canada, J5R 4B8

[21] Appl. No.: 450,815

[22] Filed: May 25, 1995

[30] Foreign Application Priority Data

May 5, 1995 [CA] Canada ..... 2148777

[51] Int. Cl.[6] ..... E04F 11/00

[52] U.S. Cl. ..... 52/182; 52/184; 52/169.7; D25/62

[58] Field of Search ..... 52/182, 184, 188, 52/190, 191, 169.7; 4/506, 496, 488; D25/62, 63

[56] References Cited

U.S. PATENT DOCUMENTS

| | | | |
|---|---|---|---|
| D. 194,399 | 1/1963 | Delmuth | D25/63 |
| D. 265,131 | 6/1982 | Wallin et al. | D25/63 |
| D. 265,251 | 6/1982 | Darby et al. | D25/63 X |
| D. 279,712 | 7/1985 | Daly | D25/62 |
| D. 283,168 | 3/1986 | Daly | D25/62 |
| D. 289,692 | 5/1987 | Daly | D25/62 |
| D. 290,044 | 5/1987 | Dahy | D25/62 |
| D. 293,475 | 12/1987 | Daly | D25/62 |
| 2,949,703 | 8/1960 | Katzmarek | 52/188 |
| 3,578,110 | 5/1971 | Seagraves | D25/63 X |
| 3,848,378 | 11/1974 | Witte | 52/184 |
| 4,438,606 | 3/1984 | Chardon et al. | 52/79.1 |
| 4,599,835 | 7/1986 | Rinke . | |
| 4,706,425 | 11/1987 | Brumbalaugh | 52/182 |

OTHER PUBLICATIONS

Publication: EZ Steps —Assembly & Installation Instructions.

Publication: Profitez encore plus de votre piscine EZ Steps.

*Primary Examiner*—Robert Canfield

*Attorney, Agent, or Firm*—Bell, Seltzer, Park & Gibson

[57] ABSTRACT

The invention relates to a structure defining a set of stairs for swimming-pool. This structure defining a set of stairs comprises a base; at least one step having a tread; and at least one supporting member supporting and connecting the tread to the base; said base cooperating with the bottom floor of the swimming-pool for positioning said structure on the bottom floor of said swimming-pool to thus prevent motion of said structure in the swimming-pool.

5 Claims, 5 Drawing Sheets

STAIRS FOR SWIMMING-POOL

BACKGROUND OF THE INVENTION a) Field of the Invention

The present invention relates to a structure defining a set of stairs for a swimming-pool, said structure being very easy to install, especially in an existing swimming-pool. Furthermore, said stairs do not require to be mechanically fastened to structural members of the swimming-pool. such as sidewalls and/or the liner and/or the bottom of the swimming-pool.

b) Brief Description of the Related Art

It is known in the art to manufacture stairs for swimming-pools, especially for onground swimming-pools. However, for positioning and preventing motion of said stairs in the swimming-pool, they always need to be mechanically secured to structural members of the swimming-pool such as a sidewall, the liner and/or the bottom of said swimming-pool. The fastening can be done with fasteners such as bolts and screws, or with means which make the stairs an integral part of the swimming-pool. An example of such stairs is shown in U.S. Pat. No. 4,599,835. In this patent, a step assembly must be connected to the top rail of a swimming-pool sidewall. Furthermore, prior art stairs always frequently require to be assembled before they are sunk in the swimming-pool.

Therefore, there is a strong need for a structure defining a set of stairs that can be kept in place in the swimming-pool without requiring any mechanical fastening to structural members of said swimming-pool, especially in the case of onground swimming-pool. Furthermore, there is a strong need for stairs which do not require to be assembled before use.

SUMMARY OF THE INVENTION

The present invention relates to a new structure defining a set of stairs for a swimming-pool, especially for an onground swimming-pool, that is very easy to install, especially in an existing swimming-pool, without requiring any mechanical fastening of said structure to define a set of stairs to the structural members of the swimming-pool. Thus, no tools or fasteners are required.

The present invention further relates to a moulded structure defining a set of stairs for a swimming-pool, especially defining a single piece moulded structure defining a set of stairs. The only operation that may be eventually required is the positioning of at least one ballast means to the structure defining a set of stairs.

The present invention further relates to a structure defining a set of stairs for a swimming-pool that is provided with means allowing to reduce the lateral pressure of water circulating in the swimming-pool.

More particularly, the present invention relates to a structure defining a set of stairs for swimming-pool, said swimming-pool comprising a bottom floor, wherein said structure comprises:

a base;

at least one step having a tread; and at least one means supporting the tread and connecting this latter to the base;

said base being provided with means adapted to cooperate with the bottom floor of the swimming-pool for positioning said structure defining a set of stairs on the bottom floor of said swimming-pool; and preventing motion of said structure defining a set of stairs in the swimming-pool.

BRIEF DESCRIPTION OF THE DRAWINGS

In order to impart full understanding of the manner in which this object and others are attained in accordance with the present invention, preferred embodiments thereof will be described hereinafter with reference to the accompanying drawings wherein.

DESCRIPTION OF PREFERRED EMBODIMENTS

Figure 1:
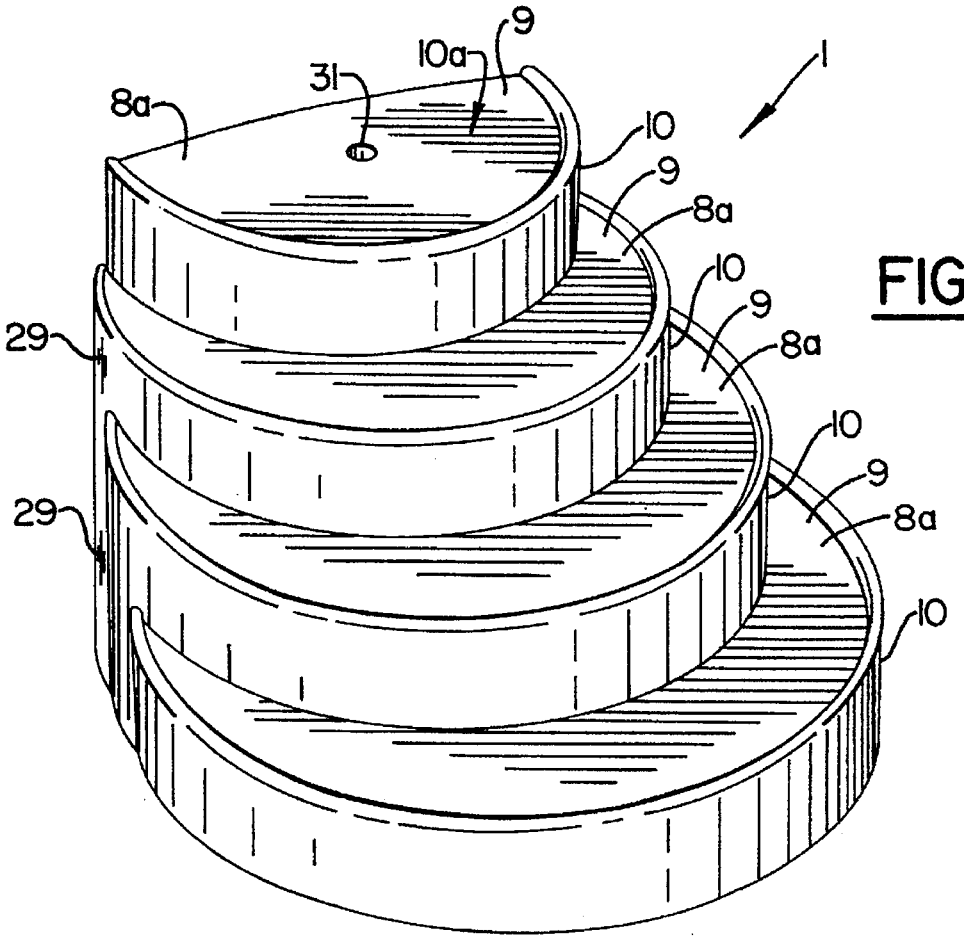
FIG. 1*a* is perspective view of a particularly preferred embodiment of a structure defining a set of stairs according to the invention.
Figure 2:
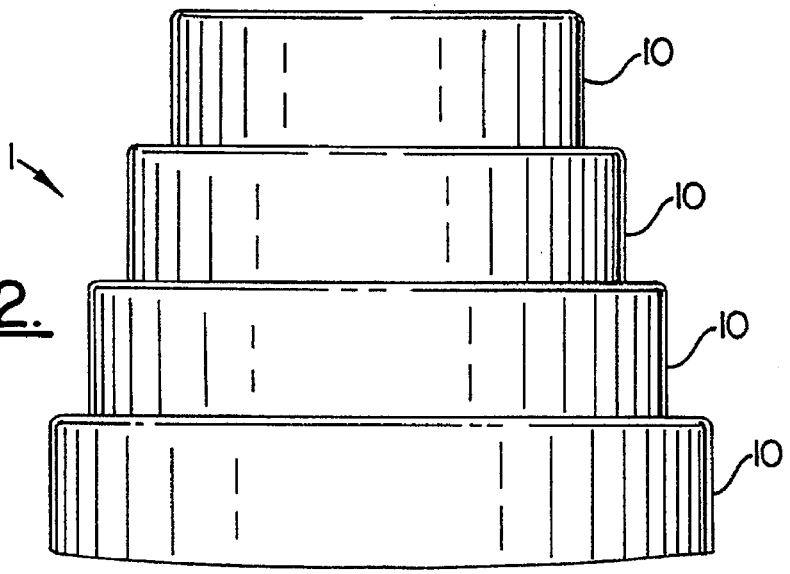
FIG. 2 is a front elevational view of the structure of FIG. 1.
Figure 3:
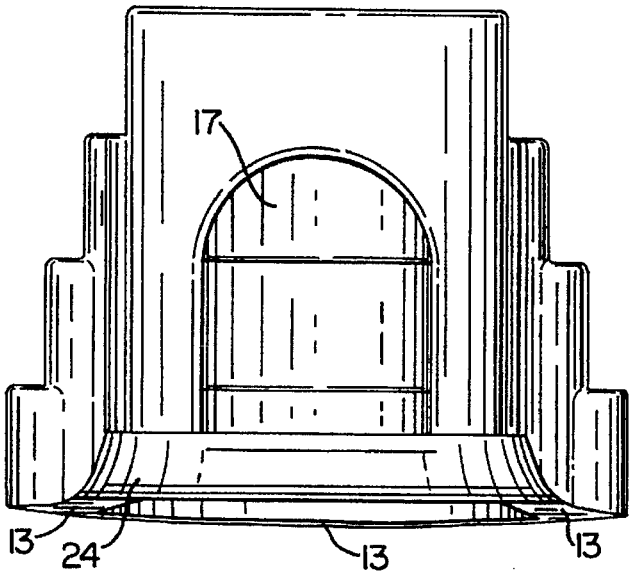
FIG. 3 is a rear elevational view of the structure of FIG. 1.
Figure 4:
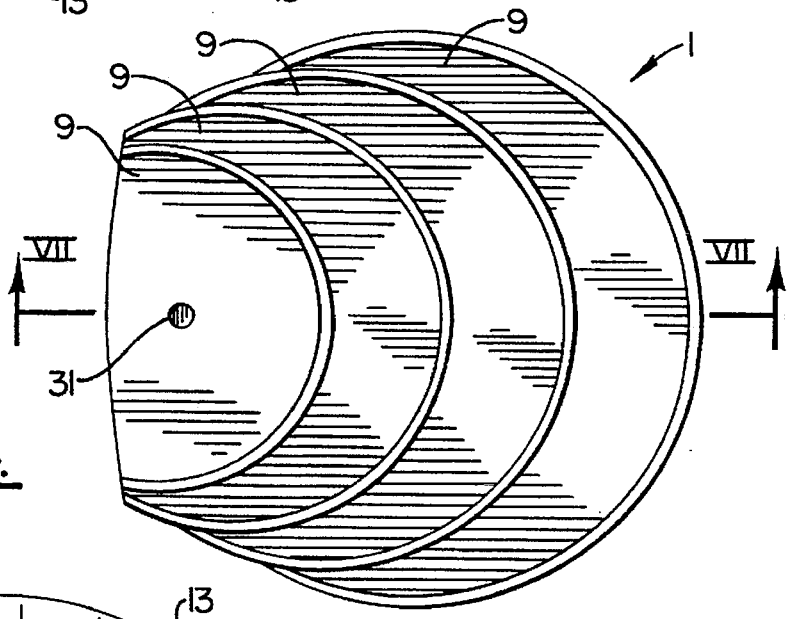
FIG. 4 is a top plane view of the structure of FIG. 1.
Figure 5:
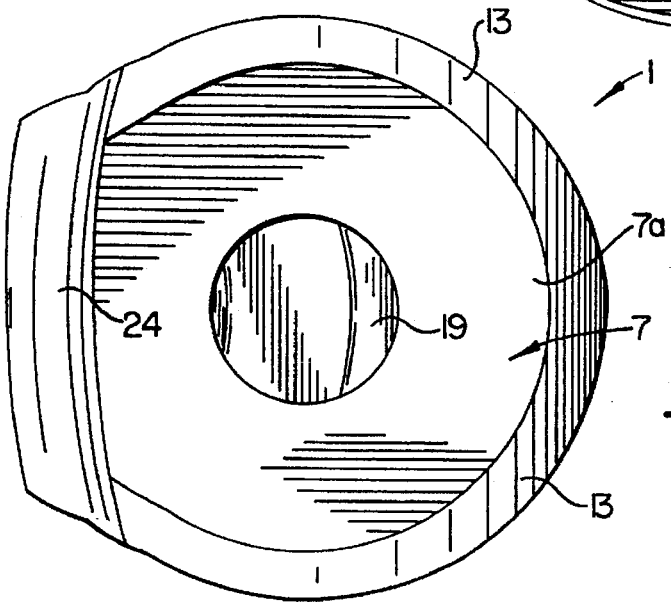
FIG. 5 is a bottom plane view of the structure of FIG. 1.
Figure 6:
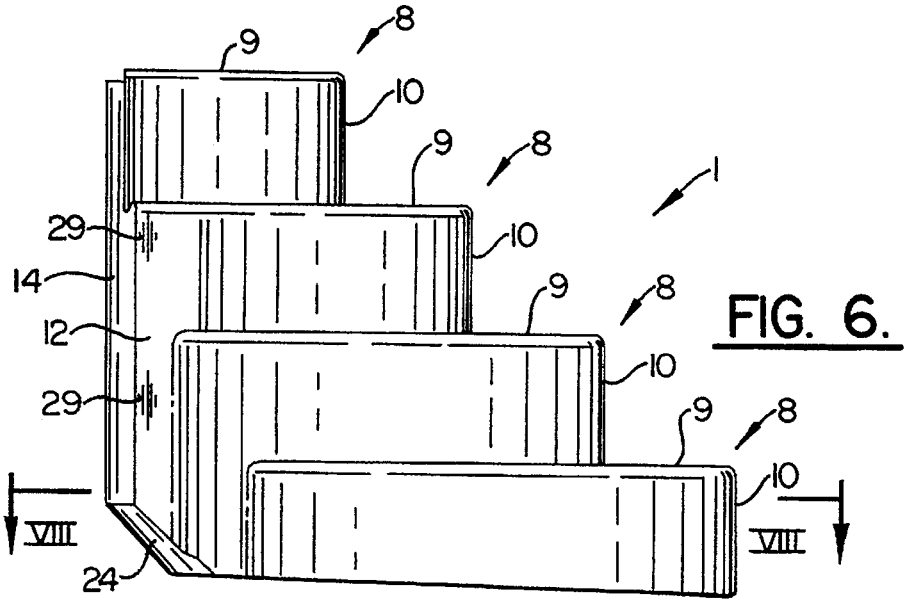
FIG. 6 is a side elevational view of the structure of FIG. 1.

Referring to the enclosed drawings, the present invention relates to a structure 1 defining a set of stairs for a swimming-pool 3 comprising a bottom floor 5. The structure comprises a base 7; at least one stair 8 each having a tread 9 (preferably four treads 9 as illustrated); and means for supporting and connecting said tread to the base.

Advantageously, as illustrated in the drawings, each stair 8 is further provided with a riser 10.

Advantageously, said means for supporting and connecting the tread(s) to the base comprise stringer walls that are preferably defined, as illustrated in the drawings, by two lateral walls 12, one rear wall 14 and eventually risers 10. Preferably, risers 10 are part of said stringer walls.

The base 7 is provided with means adapted to cooperate with the floor 5 of the swimming-pool 3 for positioning the structure 1 on the floor 5 and preventing motion of said structure 1 in the swimming-pool 3. As illustrated in the drawings, these means may comprise at least one protuberance 13 having bearing surface 15 small enough to provided a sufficient pressure on the floor 5 of the swimming-pool 3 to thus prevent motion of the structure 1.

Figure 9:
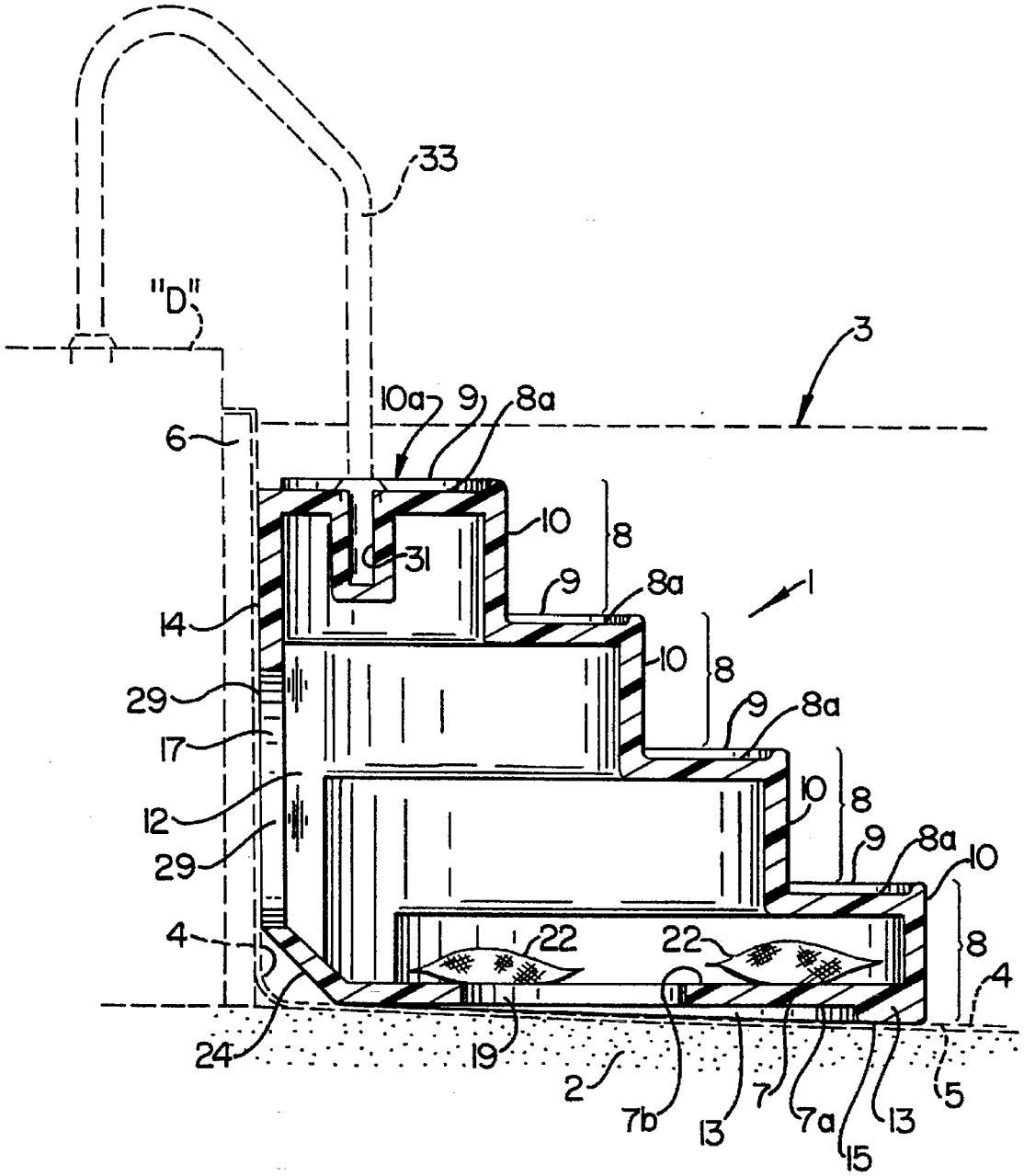
FIG. 9 is a cross sectional view of a structure defining a set of stairs configured to receive at least one handrail.
Figure 10:
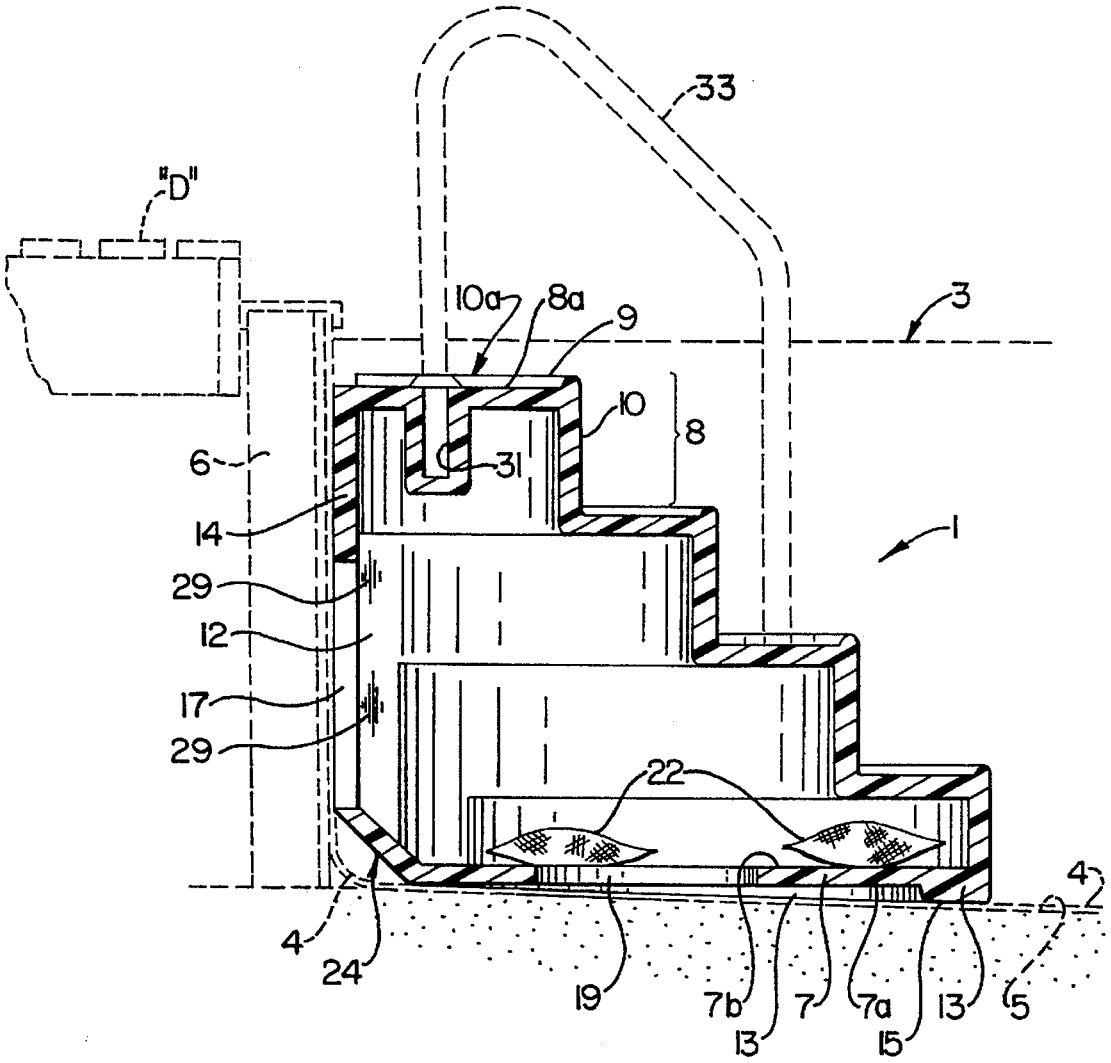
FIG. 10 is a variant of FIG. 9.

Advantageously, when the swimming-pool is, as illustrated in FIGS. 9 and 10 of the drawings, an onground swimming-pool 3 comprising a pool liner 4 enclosed within pool sidewalls 6 and resting on a ground 2 having a slight slope especially a very slight slope, then the base 7 may be substantially wedge shaped. Advantageously, the slope is of about 0.5 to 5% (preferably 3%) and the width of the tongue may vary from 1 to 6 inches (preferably 4 inches).

Figure 7:
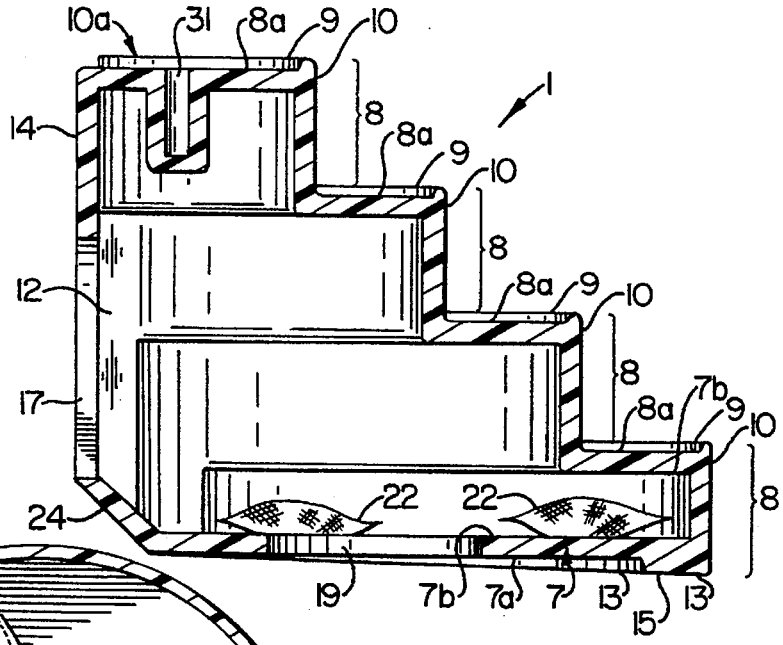
FIG. 7 is a side elevational view of the structure of FIG. 1 on the bottom of an onground swimming pool (partly shown); this side elevational view is a cross sectional view according to line VII—VII of the structure of FIG. 4.
Figure 8:
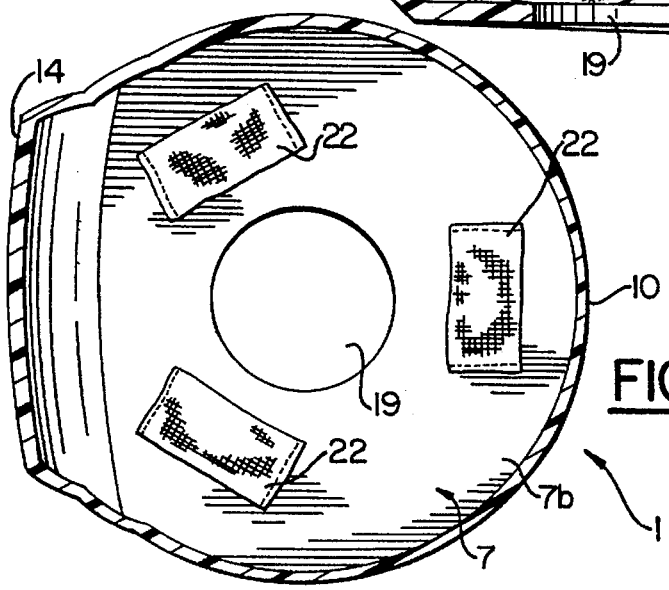
FIG. 8 is a cross sectional view according to line VIII—VIII of the structure of FIG. 6.

Advantageously, as illustrated in the drawings, the protuberance 13 is periphically located on the bottom of the base 7. This protuberance 13, as illustrated in the drawings, may consist of one tongue, peripherically located on the bottom 7*a* of the base 7. Preferably, the tongue 13 has rounded edges as illustrated in FIG. 7. This tongue has a surface 15 contacting the liner 4.

Advantageously, as illustrated in the drawings, the structure 1 may be further provided with at least one ballast means. These ballast means may consist, as illustrated in the drawings, of one or several bags 22 of sand (e.g. three bags 22). Said ballast means may be supported on supporting means, especially on the inner wall 7*b* of the base 7. Preferably, as illustrated in the drawings, there are three bags 22 uniformly distributed on the wall 7*b*. Advantageously, each bag weight about 50 lbs.

Advantageously, the rear of the base is bevelled (see reference number 24) on the one hand to avoid damaging the liner 4 and on the other hand to fit with any type of coving of said liner. Furthermore, the structure is preferably provided with rounded edges, also to avoid damage to the liner 4.

Advantageously, the stairs 8, the base 7, the optional risers 10 and the tongue 13 are integral to each other and obtained by moulding of a plastic material or curing of a curable material. Preferably, said stairs 8, treads 9, risers 10, lateral walls 12, rear wall 14, the base 7 and the tongue 13 form a moulded or cured single piece hollowed structure. Advantageously, the structure 1 is provided with a first opening 17 and eventually as illustrated in the drawings with a second opening 19 respectively provided in the rear wall 14 and the base 7.

Advantageously, the structure 1, especially the hollowed structure 1 shows a wall thickness of about ⅙", to ⅜", preferably ¼. The thickness of the walls is FIGS. 7, 9 and 10 has been volontarily exagerated for clarification purposes of the drawings only.

Advantageously, the material used to manufacture the structure 1 may be selected from the group consisting of any mouldable or curable material that is resistant to chemical compounds, has a high resistance to tearing and temperature variations and is stable with respect to U.V. radiations. Advantageously, said material is polyethylene, especially a medium density polyethylene.

Advantageously, the structure 1 may be obtained by all appropriate techniques well known in the are when it is required to manufacture a moulded or cured item. Preferably, when medium density polyethylene is used, the structure is obtained by a technique called Rotational Moulding. This technique is very well known to skilled workman and does not necessitate to be explained in detail.

Advantageously, the top of each stair 8 may be provided with a non-slipping design surface or may be associated with a member having non-slipping properties. Preferably, the top of each stair has a recess 8*a* in the bottom of which a non-slipping surface or material may be provided. For example, the bottom of the recess 8*a* may be moulded to have a "sand finish" aspect. Alternatively, a non-slipping material well known on the art (especially a sheet of elastomer) may be mounted in each recess 8*a* by any appropriate means such as gluing.

Preferably, the first opening 17 is intended to allow the insertion of ballast means (e.g. bags of sand 22) on the wall 7*b*. Also, this opening preferably in association with the second opening 19 allows to sink the structure 1 in the swimming-pool.

Optionally, each lateral walls 12 may be provided with one and preferably several third openings 29 to allow a free movement of water in and from the hollowed structure 1. This characteristic in addition of making easier the immersion of the structure further allow to reduce the pressure exerted by a water stream generated by the pump of the swimming-pool( during usual cleaning and treating of the water of the swimming-pool). Preferably as illustrated said openings 29 an elongated slots.

Advantageous, as illustrated in FIG. 9 the structure defining a set of stairs may be further provided with a casing 31 for receiving the extremities of a handrail 33 preferably as illustrated, of the type having opposite ends. One end of the rail may be housed in the casing 31 which is provided in the landing stair 10*a*. Even though both ends of the rail may be fastened by any appropriate means to respectively the landing stair 10*a* and a deck "D", this handrail 33 is not intended to mechanically fasten the structure 1 with respect to the swimming-pool sidewall, bottom, top rail, etc. Even when the opposite end of the handrail are secured to a deck surrounding the swimming-pool 3, the main purpose of said handrail is never to mechanically anchor the structure 1 and set its positioning with respect to the swimming-pool 3. In fact, as illustrated in FIG. 10, the handrail 33 may be completely mounted in the structure 1. Each end of the handrail 33 may be fastened to the deck and the structure or the structure only with a collar and screws according to techniques very well known on the art.

In use, one only has to sink the structure 1 in the swimming-pool 3, position one or several bags 22 (preferably three bags 22) on the wall 7*b*, and manually position the structure 1 to have its rear wall 14 adjacent to a corresponding wall of the swimming-pool 3. The original structure of the bottom of the base in combination with the ballast will be sufficient to position the structure 1 in the swimming-pool 3 and prevent motion of said structure 1 in said swimming-pool.

To remove the structure 1 from the swimming-pool, one only has to reverse the above steps.

Although the present invention has been explained hereinabove by way of preferred embodiments thereof, it should be pointed out that any modification to these preferred embodiments, within the scope of the appended claims, are not deemed to change or alter the nature and scope of the present invention.

What is claimed is:

1. A structure defining a set of stairs for a swimming pool, said swimming pool comprising a bottom floor, wherein said structure comprises:

a base;

at least one step having a tread;

at least one means supporting the tread and connecting this latter to the base; and at least one means for positioning said structure against the bottom floor of said swimming pool and preventing motion of said structure in the swimming pool, said means being provided on said base and adapted to cooperate with the bottom floor of the swimming pool, wherein said means of the base for positioning the structure and preventing motion of the latter comprise at least one protuberance having a bearing surface sufficient to provide pressure on the bottom of the swimming-pool and at the same time position and prevent motion of said structure, and wherein means of the base for positioning the structure and preventing motion of the latter consist of one tongue making an integral part of the bottom of the base near a peripheric edge of said base, and wherein the tongue is configured in a generally rounded shape extending around a major portion of the bottom of said base.

2. A structure defining a set of stairs for a swimming pool, said swimming pool comprising a bottom floor and side walls, wherein said structure is substantially hollow and includes at least one opening positioned therein for allowing fluid movement therethrough and comprises:

a base;

at least one step having a tread;

at least one means supporting the tread and connecting this latter to the base; and at least one means for positioning said structure against the bottom floor of said swimming pool and preventing motion of said structure in the swimming pool, said means being provided on said base and adapted to cooperate with the bottom floor of the swimming pool, wherein said means of the base for positioning the structure and preventing motion of the latter comprise at least one protuberance having a bearing surface sufficient to provide pressure on the bottom of the swimming-pool and at the same time position and prevent motion of said structure, and wherein said protuberance is peripherally positioned on the bottom of said base and extends inwardly a predetermined distance around a major portion of said base.

3. A structure according to claim 2, wherein it is further provided with at least one ballast means and with means for supporting said ballast means.

4. A structure according to claim 3, wherein the means for supporting and connecting said tread to the base comprise stringer walls comprising a rear wall and lateral walls and risers, said stringer walls and risers making an integral part of the base and the tread.

5. A structure according to claim 4, wherein the stringer walls comprising a rear wall and lateral walls and riser form with said tread and base a hollowed structure that is provided with at least a first opening provided in a stringer wall located at the rear of the structure.

* * * * *